US006834948B2

(12) United States Patent
Asano et al.

(10) Patent No.: US 6,834,948 B2
(45) Date of Patent: Dec. 28, 2004

(54) COLOR INK JET RECORDING APPARATUS

(75) Inventors: Takeshi Asano, Nagoya (JP); Yoshiyuki Ikezaki, Nagoya (JP); Takao Hyakudome, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/105,416

(22) Filed: Mar. 26, 2002

(65) Prior Publication Data

US 2002/0140794 A1 Oct. 3, 2002

(30) Foreign Application Priority Data

Mar. 30, 2001 (JP) ..... 2001-098434

(51) Int. Cl.[7] ..... B41J 2/01; B41J 2/21; B41J 2/205

(52) U.S. Cl. ..... 347/102; 347/43; 347/15; 347/101; 347/40; 347/20; 347/9; 347/5

(58) Field of Search ..... 347/101, 102, 347/43, 15, 9, 40, 20, 5

(56) References Cited

U.S. PATENT DOCUMENTS 3,960,072 A * 6/1976 Ahlgren et al. ..... 101/35
5,041,846 A * 8/1991 Vincent et al. ..... 346/25
5,371,531 A * 12/1994 Rezanka et al. ..... 347/43
5,511,477 A * 4/1996 Adler et al. ..... 101/401.1
5,864,354 A * 1/1999 Hibino et al. ..... 347/212
6,064,414 A * 5/2000 Kobayashi et al. ..... 347/172
6,084,604 A * 7/2000 Moriyama et al. ..... 347/15
6,092,890 A * 7/2000 Wen et al. ..... 347/101
6,095,636 A * 8/2000 Shioya et al. ..... 347/43
6,137,505 A * 10/2000 Hirabayashi et al. ..... 347/40
6,145,979 A * 11/2000 Caiger et al. ..... 347/102
6,309,060 B1 * 10/2001 Timmermans-Wang et al. ..... 347/88
6,312,123 B1 * 11/2001 Codos et al. ..... 347/102
6,328,413 B1 * 12/2001 Rutland et al. ..... 347/35
6,425,663 B1 * 7/2002 Eastlund et al. ..... 347/102
6,443,554 B1 * 9/2002 Yoshida ..... 347/41
6,447,112 B1 * 9/2002 Hu et al. ..... 347/102
6,523,926 B1 * 2/2003 Mitsuzawa et al. ..... 347/19

FOREIGN PATENT DOCUMENTS

JP A 60-132767 7/1985
JP A 63-62738 3/1988
JP 03295653 A * 12/1991 ..... B41J/2/01
JP 05269983 A * 10/1993 ..... B41J/2/01
JP A 7-224241 8/1995
JP A 8-21808 1/1996
JP 10309801 A * 11/1998 ..... B41J/2/01

* cited by examiner

*Primary Examiner*—Judy Nguyen
*Assistant Examiner*—Leonard Liang
(74) *Attorney, Agent, or Firm*—Oliff & Berridge, PLC

(57) ABSTRACT

In a color ink jet recording apparatus using ultraviolet cure ink, the time required for printing is shortened and color of the ink can be clearly represented without upsizing the ink jet recording apparatus. The color ink jet printer includes a carriage that can move in a main scanning direction while guided by X-axis guide bars, Y, M, C and K heads aligned in a sub scanning direction on the carriage, and two ultraviolet lamps that are disposed on both sides sandwiching the heads therebetween on the carriage and each have a sufficient length. With this structure, a printed portion of a recording medium formed by each of the Y, M, C and K heads is irradiated with ultraviolet light by the UV lamps at least once after every printing in the main scanning direction.

16 Claims, 13 Drawing Sheets

COLOR INK JET RECORDING APPARATUS

BACKGROUND OF THE INVENTION

1. Field of Invention

The invention relates to a color ink jet recording apparatus, and more particularly, to an ink jet recording apparatus that includes ink cured by irradiation of energy, a plurality of ink jet heads provided for each kind of ink for color printing and an energy generating device that irradiates a recording medium with energy for curing the ink.

2. Description of Related Art

Ink jet recording apparatuses that perform a printing operation using radiation curing type ink have been known. For example, Japanese Laid-Open Patent Publications No. 60-132767, No. 7-224241 and No. 8-21808 disclose related technologies.

Japanese Laid-Open Patent Publication No. 60-132767 discloses an ink jet recording apparatus that includes an ink jet head that ejects ink droplets of ultraviolet curing type ink onto a recording medium to print characters and the like in a dot matrix and an ultraviolet lamp that irradiates a portion where the characters and the like are printed on the recording medium with ultraviolet light.

Japanese Laid-Open Patent Publication No. 7-224241 discloses an ink jet recording apparatus that includes four ink jet heads for ultraviolet (UV) curing type inks, yellow (Y), magenta (M), cyan (C) and black (Bk) inks, and can record an image in full color with a single scan. A plurality of recording mediums are loaded in a stocker. The recording sheets are fed, one by one, to a belt conveyor by a conveyor, and then fed to a printing tray. At a first step, surface wettability of the recording medium is increased using a $UV/O_3$ lamp. Then, at a second step, printing operation is performed using the ink jet heads. At a third step, the recording medium is irradiated with ultraviolet light (hereinafter, referred to as a first apparatus).

In a modified ink jet recording apparatus disclosed in Japanese Laid-Open Patent Publication No. 7-224241, a Y head, an M head, a C head and a Bk head are disposed along a recording medium feeding path, in order, at regular intervals. An ultraviolet lamp is provided between each head and on a recording medium discharging side of the Bk head. Every time printing of one color is completed, a printed portion is irradiated with ultraviolet light (hereinafter, referred to as a second apparatus).

An ink jet recording apparatus disclosed in Japanese Laid-Open Patent Publication No. 8-21808 has a similar structure to that disclosed in Japanese Laid-Open Patent Publication No. 7-224241.

The ink jet recording apparatus disclosed in Japanese Laid-Open Patent Publication No. 60-132767 performs printing in monochrome, not in polychrome.

The ink jet recording apparatuses disclosed in Japanese Laid-Open Patent Publications No. 7-224241 and No. 8-21808 can perform printing in polychrome.

However, in the first apparatus, the recording medium is irradiated with the ultraviolet light only after printing in the four colors of inks, the Y, M, C and Bk inks, is completed, thereby causing the following problems. The UV curing type ink is cured only after the ink is irradiated with the ultraviolet light. Accordingly, the different colors of the inks may mingle before the inks are cured. If it happens, the colors of the inks cannot be clearly represented on the recording medium.

In the second apparatus, first, printing is performed on the entire recording medium using one color of the ink, and then the entire recording medium is irradiated with ultraviolet light. After that, printing is performed on the entire recording medium using another color of the ink, and then the entire recording medium is irradiated with the ultraviolet light. By doing so, unclearness or dullness of the colors of the inks on the recording medium due to the intermixture of the different colors of inks cannot occur. However, in this second apparatus, printing is performed on the entire recording medium using one color of the ink, and then the entire recording medium is irradiated with ultraviolet light. This series of operation is repeated with respect to each color of the ink. Accordingly, it takes much too long to print the entire recording medium with the four colors of inks. In addition, this apparatus becomes large in size.

SUMMARY OF THE INVENTION

The invention provides an ink jet recording apparatus that performs recording using different kinds of inks that are cured by irradiation of energy, wherein the time required for printing is shortened and colors of the inks can be clearly represented without upsizing the ink jet recording apparatus.

The ink jet recording apparatus according to an embodiment of the invention includes a plurality of ink jet heads, each of which ejects ink droplets of a different kind of ink that can be cured by irradiation of energy toward a recording medium, a carriage that is movable with respect to the recording medium in a main scanning direction and in a sub scanning direction perpendicular to the main scanning direction with the ink jet heads mounted on the carriage and aligned in the sub scanning direction, a movement generating device that moves the carriage with respect to the recording medium, a print control device that controls the ink jet heads and movement generating device so that the ink droplets ejected from each of the ink jet heads overlap each other on the recording medium by performing ejection of ink using the ink jet heads while moving the carriage with respect to the recording medium in the main scanning direction and by moving the recording medium in the sub scanning direction by a predetermined amount with respect to the carriage after every ejection of ink done during one way or two way moving of the carriage in the main scanning direction is performed, and an energy generating device that irradiates the recording medium with energy for curing the ink droplets ejected on the recording medium by the ink jet heads so that a printed portion of the recording medium formed by one of the ink jet heads during one reciprocation of the carriage in the main scanning direction is irradiated, at least once, before another of the ink jet heads ejects the ink droplet to a portion of the recording medium which is same portion as the printed portion formed by one of the ink jet heads.

According to the ink jet recording apparatus of the invention, the print control device moves the recording medium in the sub scanning direction with respect to the carriage after every printing is performed by moving the carriage in the main scanning direction with respect to the recording medium. The plurality of ink jet heads are aligned in the sub scanning direction perpendicular to the main scanning direction, on the carriage that can move in the main scanning direction with respect to the recording medium. For example, a yellow (Y) ink jet head, a magenta (M) ink jet head, a cyan (C) ink jet head and a black (K) ink jet head are aligned in this order in the sub scanning direction, on the carriage. In this case, an end of the recording medium in the sub scanning direction is located in a position opposite to the Y head. First, the carriage is moved in the main scanning direction with respect to the recording medium to perform printing using the Y head. Then, a portion printed in the Y ink is cured by irradiation of energy from the energy generating device.

The printed portion is an area that is to be formed by printing performed by the movement of the carriage in the main scanning direction with respect to the recording medium. The printed portion is defined by an amount of travel in the main scanning direction of the ink jet heads via the carriage and a width of ink ejection by a plurality of nozzles formed in the ink jet heads. The amount of travel in the main scanning direction of the ink jet heads is equal to a length of the printed portion in the main scanning direction (a printed length of the recording medium). The width of the ink ejection is equal to a length of the printed portion in the sub scanning direction. The printed portion defined as described above is referred to as one-line printing.

Next, the recording medium is moved in the sub scanning direction with respect to the carriage by the length of the printed portion in the sub scanning direction formed by one-line printing. As a result, printing can be performed using the Y and M heads this time. At that time, ink droplets to be ejected from the M head are ejected onto the Y ink that has already cured. Accordingly, the Y ink and the M ink do not intermix, so that the colors of the inks can be clearly represented. Next, the recording medium is moved in the sub scanning direction with respect to the carriage by the length of the printed portion in the sub scanning direction formed by one-line printing. This time, printing is performed using the yellow, magenta and cyan ink jet heads. At that time, also, ink droplets to be ejected from the M and C heads are ejected onto the other colors of inks that have already cured. Accordingly, the different colors of inks do not intermix, so that the colors of the inks can be clearly represented. Next, the recording medium is, again, moved in the sub scanning direction with respect to the carriage by the length of the printed portion in the sub scanning direction formed by one-line printing. This time, printing is performed using the Y, M, C and K heads. At that time, also, ink droplets to be ejected from the M, C and K heads are ejected onto the other colors of inks that have already cured. Accordingly, the different colors of inks do not intermix, so that the colors of the inks can be clearly represented. After that, this operation is repeated, and thus printing can be performed on the entire recording medium in color.

According to the ink jet recording apparatus, as described above, the ink jet heads are aligned in the sub scanning direction on the carriage and the print control as described above is performed. Therefore, the time required for printing in this apparatus is almost the same as or shorter than that required in an ink jet recording apparatus that performs printing in monochrome. In addition, the ink jet heads for such as the M, C and K inks, are mounted on the carriage, so that the ink jet recording apparatus does not become large in size. Further, registration of the recording medium between the ink jet heads is unnecessary for every printing in each color of ink, though it is required every printing in each color of ink in the second apparatus. Consequently, occurrence of displacements of colors or out-of-register colors can be minimized.

BRIEF DESCRIPTION OF THE DRAWINGS

Embodiments of the invention will be described in detail with reference to the following figures wherein.

DETAILED DESCRIPTION OF PREFERRED EMBODIMENTS

Figure 1A:
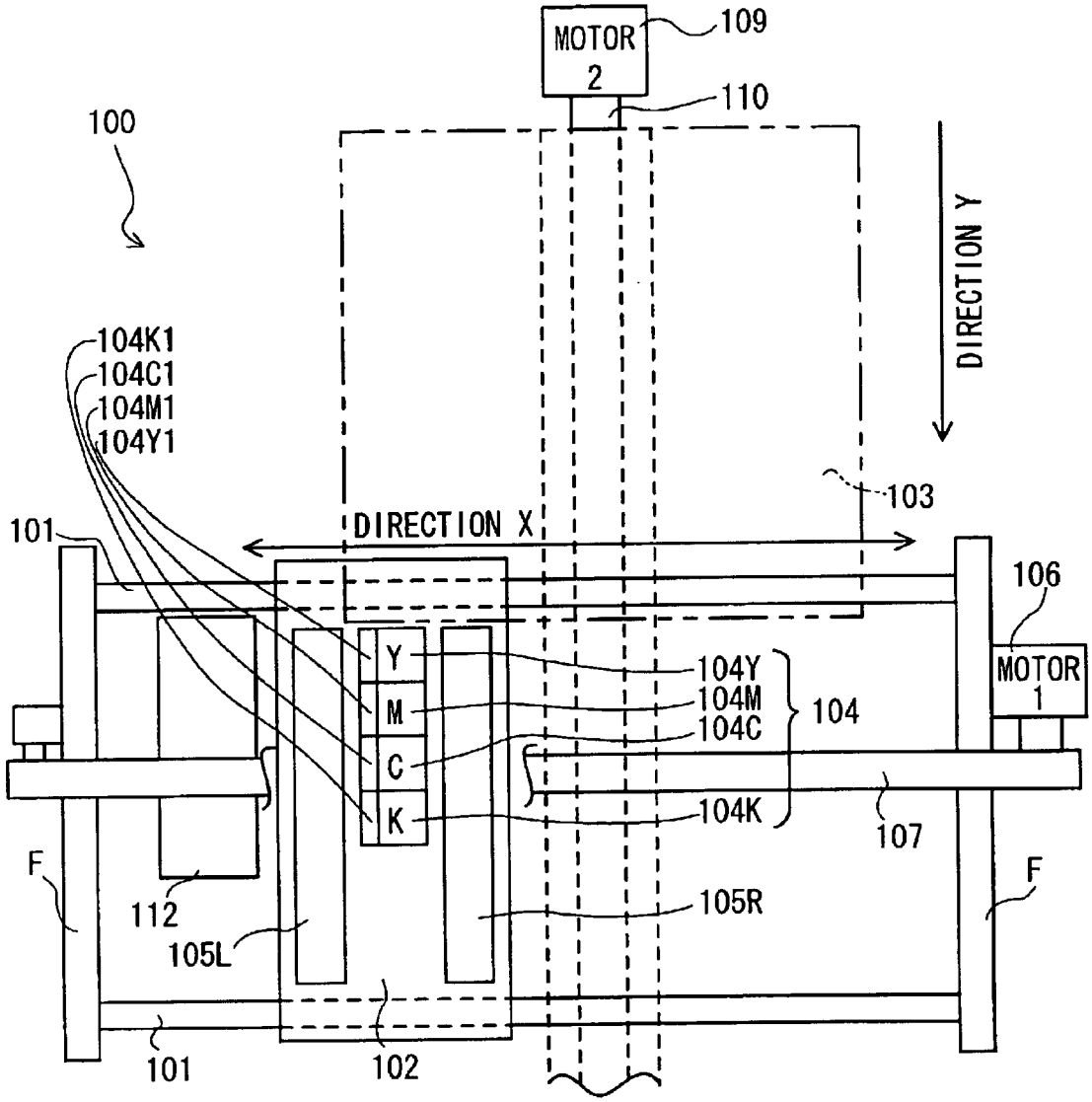
FIG. 1A is a plan view of a color ink jet printer of a first embodiment of the invention.
Figure 1B:
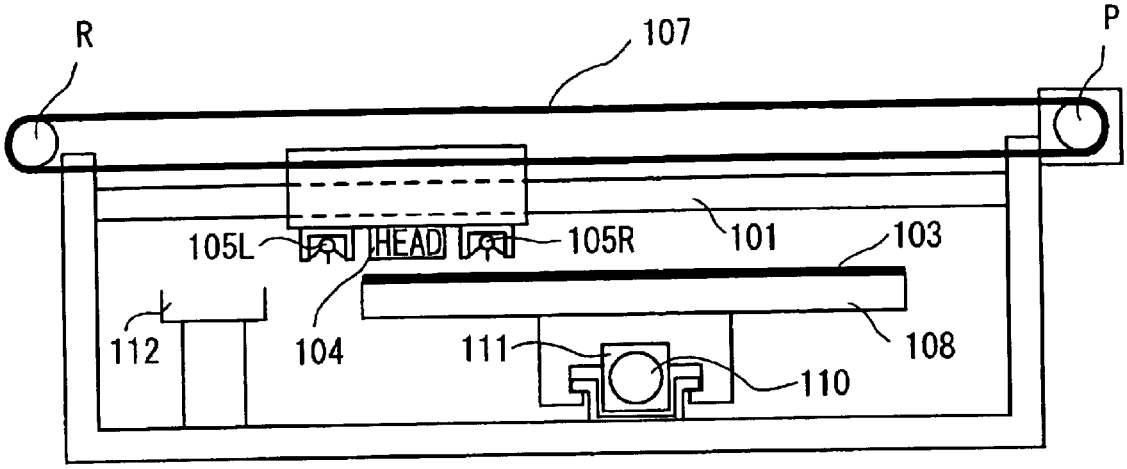
FIG. 1B is a front view of the color ink jet printer of the first embodiment.

Embodiments of the invention will be described with reference to the accompanying drawings. As shown in FIG. 1, a color ink jet printer 100 of a first embodiment includes a carriage 102 that can move in a main scanning direction (an X-axis direction) while guided by X-axis guide bars 101, 101 fixed to a frame F. A print head 104 and ultraviolet (UV) lamps 105L, 105R are provided on the carriage 102. The print head 104 includes a Y head 104Y for yellow (Y) ink, an M head 104M for magenta (M) ink, a C head 104C for cyan (C) ink and a K head 104K for black (K) ink. The ink to be ejected from the heads 104Y, 104M, 104C, 104K is an ultraviolet curing type ink (UV ink). The heads 104Y, 104M, 104C and 104K are aligned in a sub scanning direction (a Y-axis direction), which is perpendicular to the main scanning direction, on the carriage 102. The UV lamps 105L, 105R are provided on right and left sides of the print head 104 so as to sandwich the print head 104 therebetween.

The UV lamps 105L, 105R irradiate the UV ink, ejected from the respective ink heads onto a recording medium 103, with ultraviolet light to increase its viscosity to cure the ink.

Each of the heads 104Y, 104M, 104C, 104K is formed with a plurality of nozzles, which face a platen 108 (described later) and are basically aligned in parallel to the sub scanning direction. The Y head 104Y, the M head 104M, the C head 104C and the K head 104K are connected with an yellow ink tank 104Y1 containing UV yellow ink, a magenta ink tank 104M1 containing UV magenta ink, a cyan ink tank 104C containing UV cyan ink, and a black ink tank 104K1 containing UV black ink, respectively. Each UV ink is supplied from the respective ink tanks 104Y1, 104M1, 104C1, 104K1 to the respective nozzles through each ink flow path in the respective heads 104Y, 104M, 104C, 104K. Therefore, when one-line printing is performed by ejecting ink droplets of the UV ink from each head 104Y, 104M, 104C, 104K while the carriage 102 is moved in the main scanning direction, a printed portion is formed on the recording medium 103. A width of the printed portion is equal to a carriage traveling distance in the main scanning direction. A length of the printed portion is equal to a width of ink ejection from each head (a width of ink ejection from the nozzles in each head at a time).

An X-axis motor 106 that moves the carriage 102 in the sub scanning direction is attached to one of side walls of the frame F. A driven pulley R is rotatably provided to the other side wall of the frame F. A timing belt 107 is stretched between the driven pulley R and a drive pulley P fixed to an output shaft of the X-axis motor 106. The timing belt 107 is engaged with the carriage 102. Thus, as the X-axis motor 106 is driven, the carriage 102 travels from side to side along the X-axis guide bars 101, 101, that is, the X-axis guide bars 101, 101 and the X-axis motor 106 moves the carriage 102 in the main scanning direction with respect to the recording medium 103. The platen 108 is supported by the frame F, under the carriage 102 and the X-axis guide bars 101, 101 so as to be movable in the sub scanning direction perpendicular to the main scanning direction. The platen 108 is formed with a plurality of air-intakes at its top, and a recording medium 103, such as a plastic plate, is placed on the top. Air is taken in from the air-intakes with the recording medium 103 placed on the top (a surface for placing the recording medium 103), so that a negative pressure is generated and thus the recording medium 103 is statically held on the platen 108. As described above, the platen 108 is provided with an air taking mechanism for holding the recording medium 103. The air taking mechanism also functions as a holding device for holding the recording medium 103. The holding device is not limited to the air taking mechanism. However, various types of holding devices can be adopted. For example, a clamp mechanism that mechanically presses and holds the recording medium 103 on the platen 108 can be adopted.

A screw shaft 110, extending in a direction perpendicular to the main scanning direction, is rotatably supported by the frame F. One end of the screw shaft 110 is secured to an output shaft of a Y-axis motor 109. A bearing 111, into which the screw shaft 110 is threaded, is fixed under the platen 108. As the screw shaft 110 is rotated by the Y-axis motor 109, the platen 108 is moved in the sub scanning direction. A screw mechanism having the screw shaft 110, the bearing 111 and the Y-axis motor 109 moves the platen 108 in the sub scanning direction with respect to the carriage 102.

The amount and direction of travel of the carriage 102 is controlled by controlling the amount and direction of rotation of the X-axis motor 106. For example, a pulse motor is preferably used as the X-axis motor 106. The amount and direction of travel of the platen 108 is controlled by controlling the amount and direction of rotation of the Y-axis motor 109. For example, a pulse motor is preferably used as the Y-axis motor 109.

An area 112 is a maintenance area in which purging, wiping, flushing and the like are performed. As shown in FIG. 1A, the UV lamps 105L, 105R are longer than the print head 104 in a direction of feeding the recording medium 103 by a predetermined length.

Figure 2:
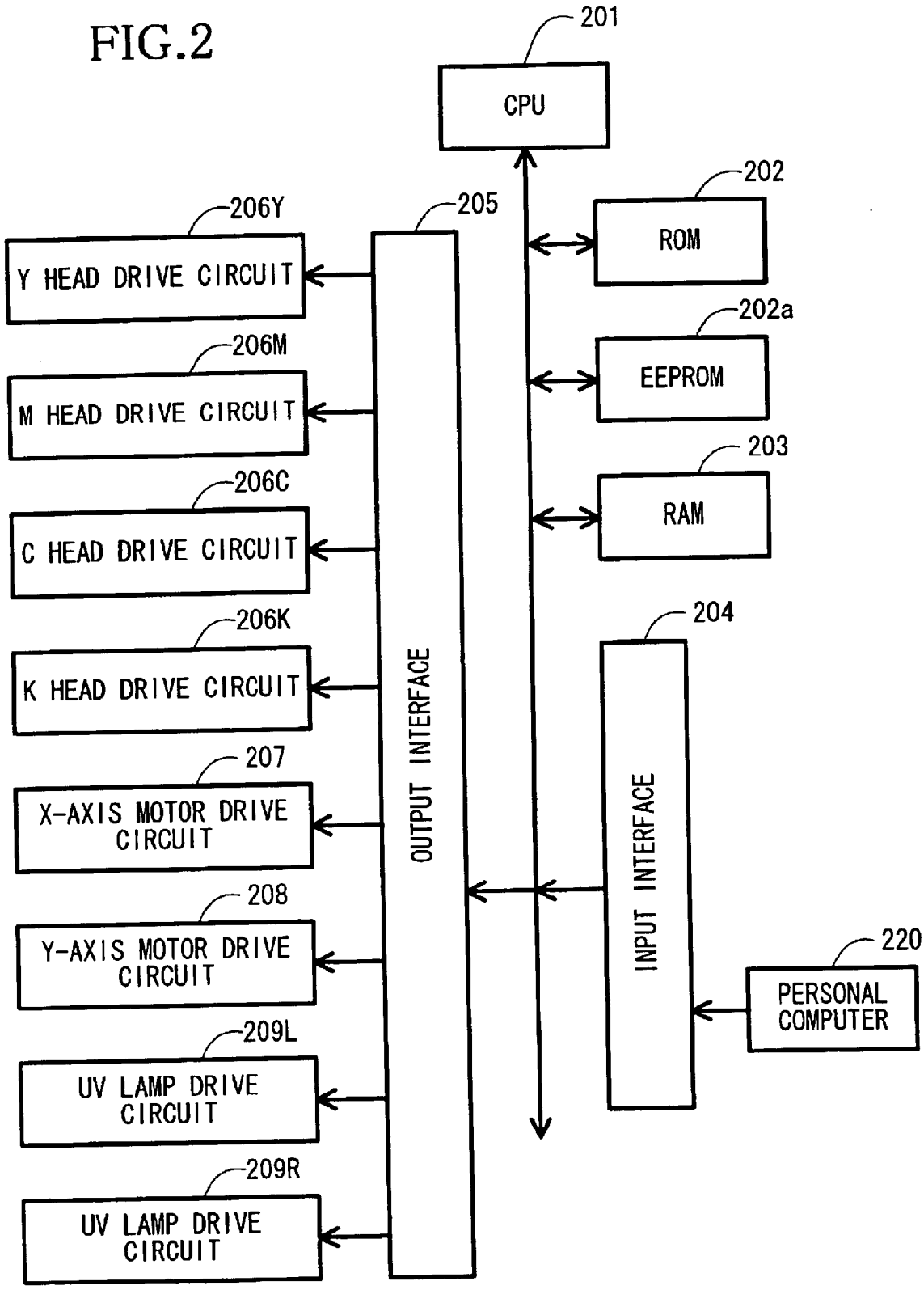
FIG. 2 is a schematic block diagram showing a control system of the ink jet printer of the first embodiment.

As shown in FIG. 2, a control system of the color ink jet printer 100 includes a CPU 201, a ROM 202, an EEPROM 202*a*, a RAM 203, an input interface 204 and an output interface 205. The output interface 205 is connected with a Y head drive circuit 206Y, an M head drive circuit 206M, a C head drive circuit 206C, a K head drive circuit 206K, an X-axis motor drive circuit 207, a Y-axis motor drive circuit 208 and UV lamp drive circuits 209L, 209R. A control signal and data from a personal computer 220 are inputted to the input interface 204.

Figure 3:
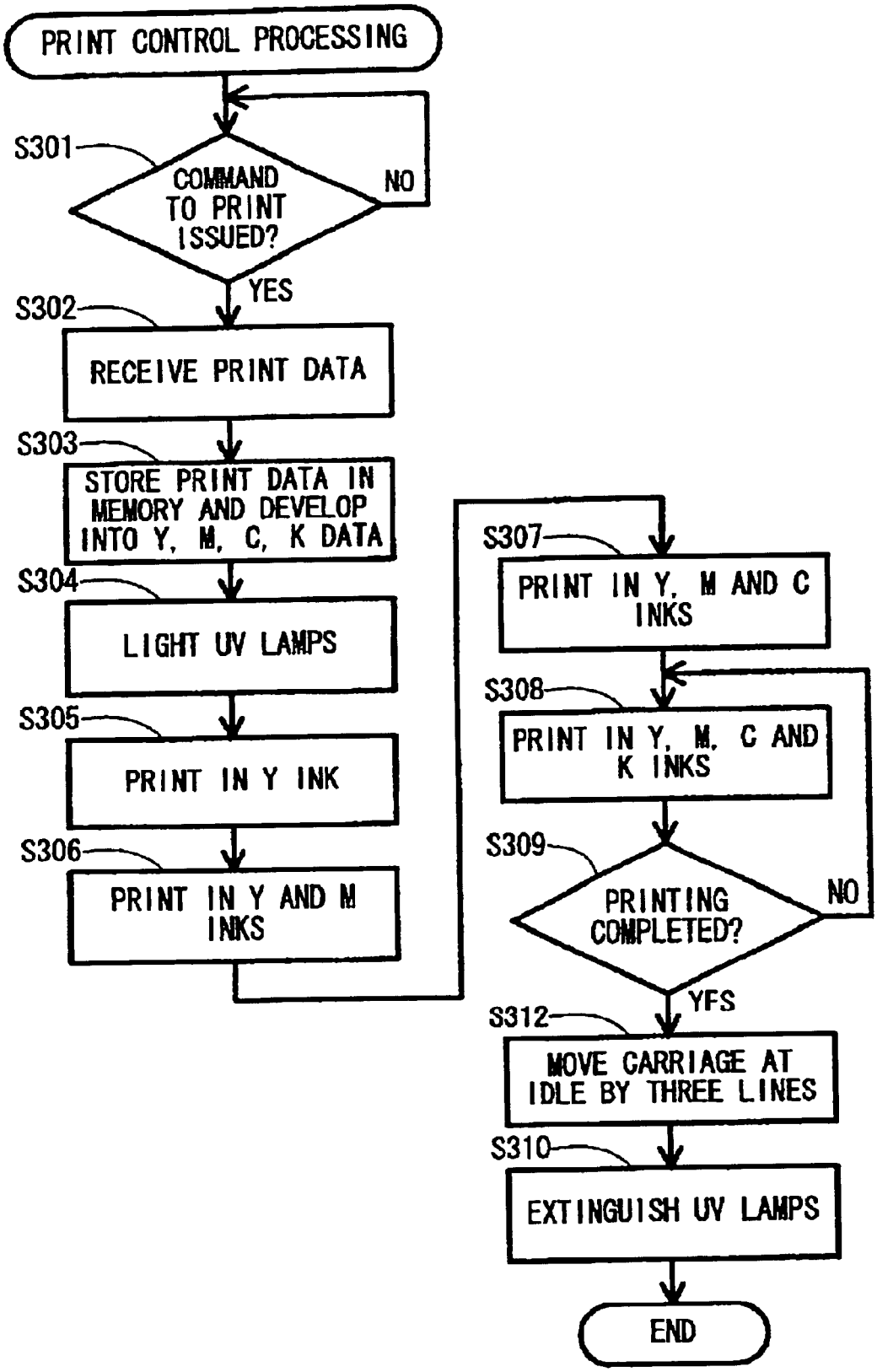
FIG. 3 is a flowchart of control processing to be executed in the ink jet printer of the first embodiment.

FIG. 3 is a flowchart for performing print control processing. A first, the CPU 201 determines whether a command to start printing has been issued from the personal computer 220 (S301). When the CPU 201 determines that the command to start printing has been issued (S301:YES), the CPU 201 receives print data (S302). After the CPU 201 receives a page of print data, the CPU 201 stores the print data in the RAM 203 and develops the print data into one page of data of each color of Y, M, C, K (S303). Then, the CPU 201 lights the UV lamps 105L, 105R (S304). After that, based on the Y data, while outputting one line of dot data to the Y head drive circuit 206Y, the CPU 201 performs one-line printing in the UV yellow ink by moving the carriage 102 in the main scanning direction (S305).

One-line printing is performed as described below. A print data developing area for one page is provided according to color in the RAM 203. One page of dot data is developed into each print data developing area in the bitmap format in which dots are aligned in the main scanning direction and in the sub scanning direction. Each dot in the dot data represents ejection (nonejection) of an ink droplet from one nozzle. One-line printing of dot data is that dots equal to the number of nozzles aligned in the sub scanning direction are selected in the sub scanning direction and rows of the selected dots are aligned in the main scanning direction from a print start side to a print end side. Dots equal to the number of nozzles aligned in the sub scanning direction are selected and referred to as dot rows. While the dot rows are sequentially read from the print data developing area from the print start side to the print end side and supplied to each head 104Y, 104M, 104C, 104K, the print head 104 is moved in the main scanning direction, thereby one line of a printed portion is formed on a recording medium 103. Upon performing the printing, a printed portion is irradiated with ultraviolet light by the UV lamps 105L, 105R disposed adjacent to the print head 104 to increase its viscosity.

Next, the CPU 201 moves the platen 108 in the sub scanning direction by one line (by the width of the ink ejection from the print head 104). Then, while outputting each one line of the dot data to the respective Y and M head drive circuits 206Y and 206M based on each Y and M data, respectively, the CPU 201 performs one-line printing in each of the UV yellow ink and the UV magenta ink by moving the carriage 102 in the main scanning direction (S306).

That is, at S305, one-line printing of the first line of the Y data has been performed. Therefore, next, dot data of the Y data for a second line is selected and provided to the Y head drive circuit 206Y and dot data of the M data for a first line is selected and provided to the M head drive circuit 206M. In other words, ink droplets of the UV magenta ink to be ejected according to the M data are ejected on the first line of the UV yellow ink ejected at S305. However, the viscosity of the UV yellow ink ejected prior to the ejection of the UV magenta ink has already been increased by the irradiation by the UV lamps 105L, 105R, so that the UV yellow ink and the UV magenta ink do not intermix and clarity of the ink colors is not degraded. Upon performing the printing in each of the UV yellow ink and the UV magenta ink, the UV yellow ink and the UV magenta ink ejected at S306 are irradiated with ultraviolet light by the UV lamps 105L, 105R to increase their viscosity.

Next, the CPU 201 moves the platen 108 in the sub scanning direction by one line. Then, while outputting each one line of the dot data to the respective Y, M and C head drive circuits 206Y, 206M and 206C based on each Y, M and C data, respectively, the CPU 201 performs one-line printing in each of the UV yellow ink, the UV magenta ink and the UV cyan ink by moving the carriage 102 in the main scanning direction (S307).

That is, dot data of the Y data for a third line, dot data of the M data for a second line and dot data of the C data for a first line are selected and supplied to the Y head drive circuit 206Y, the M head drive circuit 206M and the C head drive circuit 206C, respectively. In other words, ink droplets of the UV cyan ink to be ejected according to the C data are ejected on the first line of the UV magenta ink ejected at S306. However, the viscosity of the UV magenta ink has already been increased by the irradiation by the UV lamps 105L, 105R, so that the UV magenta ink and the UV cyan ink do not intermix and clarity of the ink colors is not degraded. In short, the first line of the UV magenta ink is ejected over the first line of the UV yellow ink, and the first line of the UV cyan ink is ejected over the first line of the UV magenta ink. One-line printing according to the M and Y data is also performed in the same manner described above.

Next, the CPU 201 moves the platen 108 in the sub scanning direction by one line. Then, while outputting each one line of the dot data to the respective Y, M, C and K head drive circuits 206Y, 206M, 206C and 206K based on each Y, M, C and K data, respectively, the CPU 201 performs one-line printing in each of the UV yellow ink, the UV magenta ink, the UV cyan ink and the UV black ink by moving the carriage 102 in the main scanning direction (S308).

That is, dot data of the Y data for a fourth line, dot data of the M data for a third line, dot data of the C data for a second line and dot data of the K data for a first line are selected and supplied to the Y head drive circuit 206Y, the M head drive circuit 206M, the C head drive circuit 206C and the K head drive circuit 206K, respectively. At S308, if the K data to be read is dot data for a Nth line (N is a whole number), the Y data is dot data for N+3th line, the M data is dot data for N+2 th line and the C data is dot data for N+1 th line. If the CPU 201 makes a determination in the negative at S309 described later, the CPU 201 sequentially increments N and reads dot data. The ejected ink droplets are irradiated with the ultraviolet light to increase their viscosity immediately after the ink droplets are ejected.

Then, the CPU 201 determines whether all printing has completed (S309). If the printing has not completed yet (S309:NO), dot data of each of the Y, M, C and K data for a next line is read and printing is performed according to the data at S308 until the printing is completed.

The repetition of the one-line printing and the transport of the platen 108 will make the printing operation reach a last line in order of the Y head 104Y, the M head 104M, the C head 104C and the K head 104K. When dot data that is to be used for printing is not left as to all the heads 104Y, 104M, 104C, 104K, the CPU 201 determines that the printing has completed. At S308, dot data of each color is read. At that time, if dot data of each color has already been used for printing in a last line, the CPU 201 outputs dot data that means nonejection of ink as to the dot data of each color.

When the CPU 201 determines that the printing has completed (S309:YES), the CPU 201 moves the carriage 102 at idle by three lines without ejecting ink droplets from the heads 104Y, 104M, 104C, 104K (S312). The UV black ink ejected last is irradiated with the ultraviolet light for the time of the one-line printing at the moment. That is, the irradiation time of the ultraviolet light to the last printed portion in the UV black ink is shorter than that to the other printed portion, so that the carriage 102 is moved at idle to irradiate the ultraviolet light to cover a shortfall. That is, the UV yellow ink is irradiated with ultraviolet light three times before the UV black ink is ejected, the UV magenta ink is irradiated twice before the UV black ink is ejected, and the UV cyan ink is irradiated once before the UV black ink is ejected. Therefore, if the irradiation of the ultraviolet light is finished when the ejection of the UV black ink in the last line is completed, the irradiation amount of the ultraviolet light to the area of three lines from the last printed line is less than that to the other portions. Due to lack of the irradiation, the viscosity of the UV black ink ejected in the last line may not be sufficiently increased or the ink may not be sufficiently cured. To avoid this, the carriage 102 is moved at idle the number of times that is one less than the number of heads to average the time of the irradiation of the ultraviolet light. By doing so, the inks ejected onto the recording medium 103 are equally cured. After that, the CPU 201 extinguishes the UV lamps 105L, 105R (S310), and thus this processing has completed.

According to the color ink jet printer 100 of the first embodiment, the UV lamps 105L, 105R are mounted on the carriage 102 to be placed front and/or behind of the ink jet heads 104Y, 104M, 104C, 104K in the main scanning direction. Thus, cure of ink can be performed in parallel with ink ejection from each ink jet heads 104Y, 104M, 104C, 104K. The color ink jet printer 100 does not become large in size, and the time required for printing can be shortened. Further, the colors of the printing can be clearly represented.

The UV lamps 105L, 105R are longer than the ink jet heads 104Y, 104M, 104C, 104K in the sub scanning direction, so that cure of ink can be performed with respect to all ink jet heads 104Y, 104M, 104C, 104K at a time in parallel with ink ejection from the ink jet heads 104Y, 104M, 104C, 104K. Further, the substantially same amount of energy can be irradiated to each color of ink on a recording medium 103, so that the ink can be evenly cured.

Next, a second embodiment of the invention will be described with reference to FIGS. 4 and 5. In the second embodiment, the control processing executed by the CPU 201 in the color ink jet printer 100 of the first embodiment is partially changed.

Figure 4:
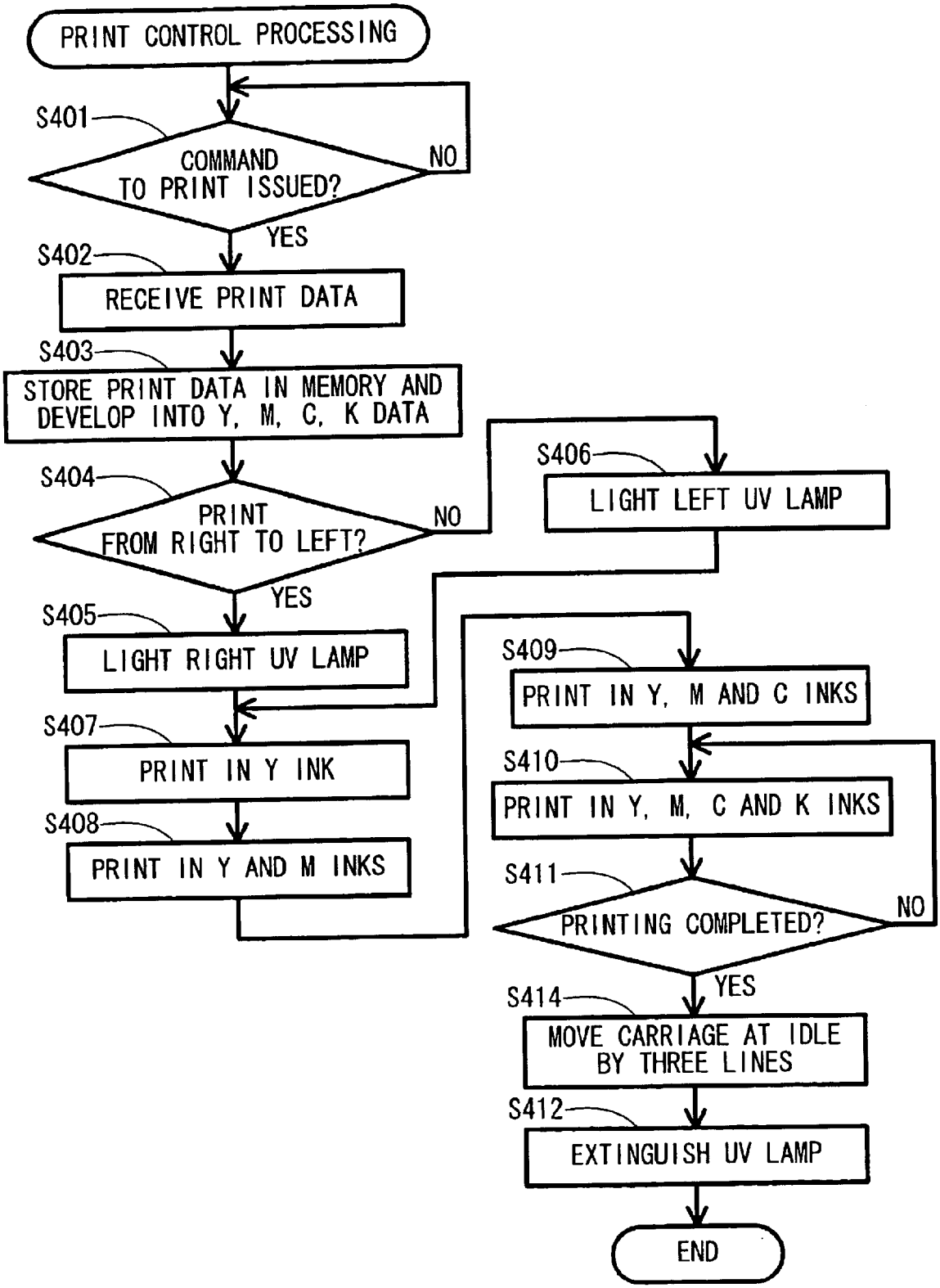
FIG. 4 is a flowchart of control processing to be executed in an ink jet printer of a second embodiment of the invention.

As shown in FIG. 4, in the print control processing of the second embodiment, the CPU 201 determines whether a command to start printing has been issued from the personal computer 220 (S401). When the CPU 201 determines that the command to start printing has been issued (S401:YES), the CPU 201 receives print data (S402). After the CPU 201 receives all print data, the CPU 201 stores the print data into the RAM 203 and develops the print data into Y, M, C and K data (S403). Then, the CPU 201 determines whether a line to be printed this time is to be printed while the carriage 102 is moved from the left to the right or it is moved from the right to the left (S404). When the printing is to be performed from the right to the left (S404:YES), the CPU 201 lights the right UV lamp 105R and stays the left UV lamp 105L off (S405). On the other hand, when the printing is to be performed from the left to the right (S404:NO), the CPU 201 lights the left UV lamp 105L and stays the right UV lamp off (S406). Then, according to the Y data, while outputting one line of dot data to the Y head drive circuit 206Y, the CPU 201 performs one-line printing in the UV cure yellow ink by moving the carriage 102 in the main scanning direction (S407). At the same time, the ink droplets ejected on the recording medium 103 are cured.

Then, the CPU 201 moves the platen 108 in the sub scanning direction by one line. After that, while the UV lamps 105L, 105R are in a state of reverse to the previous state, the CPU 201 outputs each of one line of the dot data to the respective Y and M head drive circuits 206Y and 206M based on the Y and M data, respectively. At the same time, the CPU 201 performs one-line printing in each of the UV yellow ink and the UV magenta ink by moving the carriage 102 in the main scanning direction (S408). Upon ejection of the ink droplets of the UV yellow ink and the UV magenta ink, the ink droplets are cured by the irradiation of the ultraviolet light.

Then, the CPU 201 moves the platen 108 in the sub scanning direction by one line. While the UV lamps 105L, 105R are in a state of reverse to the previous state, the CPU 201 outputs each of one line of the dot data to the respective Y, M and C head drive circuits 206Y, 206M and 206C based on the Y, M and C data, respectively. At the same time, the CPU 201 performs one-line printing in each of the UV yellow ink, the UV magenta ink and the UV cyan ink by moving the carriage 102 in the main scanning direction (S409).

Next, the CPU 201 moves the platen 108 in the sub scanning direction by one line. While the UV lamps 105L, 105R are in a state of reverse to the previous state, the CPU 201 outputs each of one line of the dot data to the respective Y, M, C and K head drive circuits 206Y, 206M, 206C and 206K based on the Y, M, C and K data, respectively. At the same time, the CPU 201 performs one-line printing in each of the UV yellow ink, the UV magenta ink, the UV cyan ink and the UV black ink by moving the carriage 102 in the main scanning direction (S410).

Then, the CPU 201 determines whether the printing has completed (S411). If all the printing has not completed yet (S411:NO), the processing at S410 is repeated until the printing is completed. When the CPU 201 determines that the printing has completed (S411:YES), the CPU 201 moves the carriage 102 at idle by three lines (S414) and then extinguishes the UV lamp, which currently lights (S412). Thus, the processing has completed.

Figure 5A:
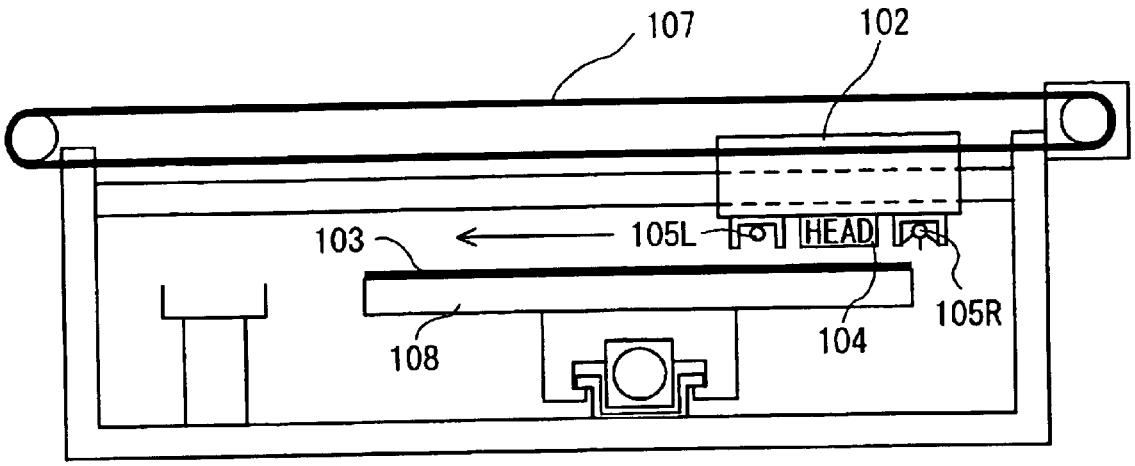
FIG. 5A is a front view showing an operation of the ink jet printer of the second embodiment.
Figure 5B:
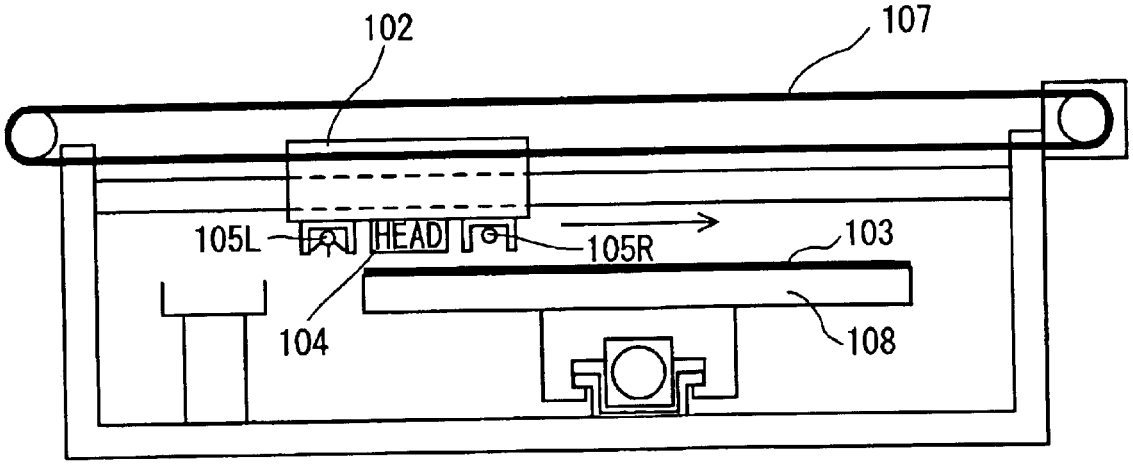
FIG. 5B is a front view showing the operation of the ink jet printer of the second embodiment.

As a result, in the second embodiment, while the printing is performed from the right to the left in the main scanning direction, as shown in FIG. 5A, only the right UV lamp 105 lights. While the printing is performed from the left to the right, as shown in FIG. 5B, only the left UV lamp 105 lights. Accordingly, the time required for printing can be shortened by performing printing back and forth. As compared with the first embodiment, the amount of energy consumption can be saved.

Figure 6A:
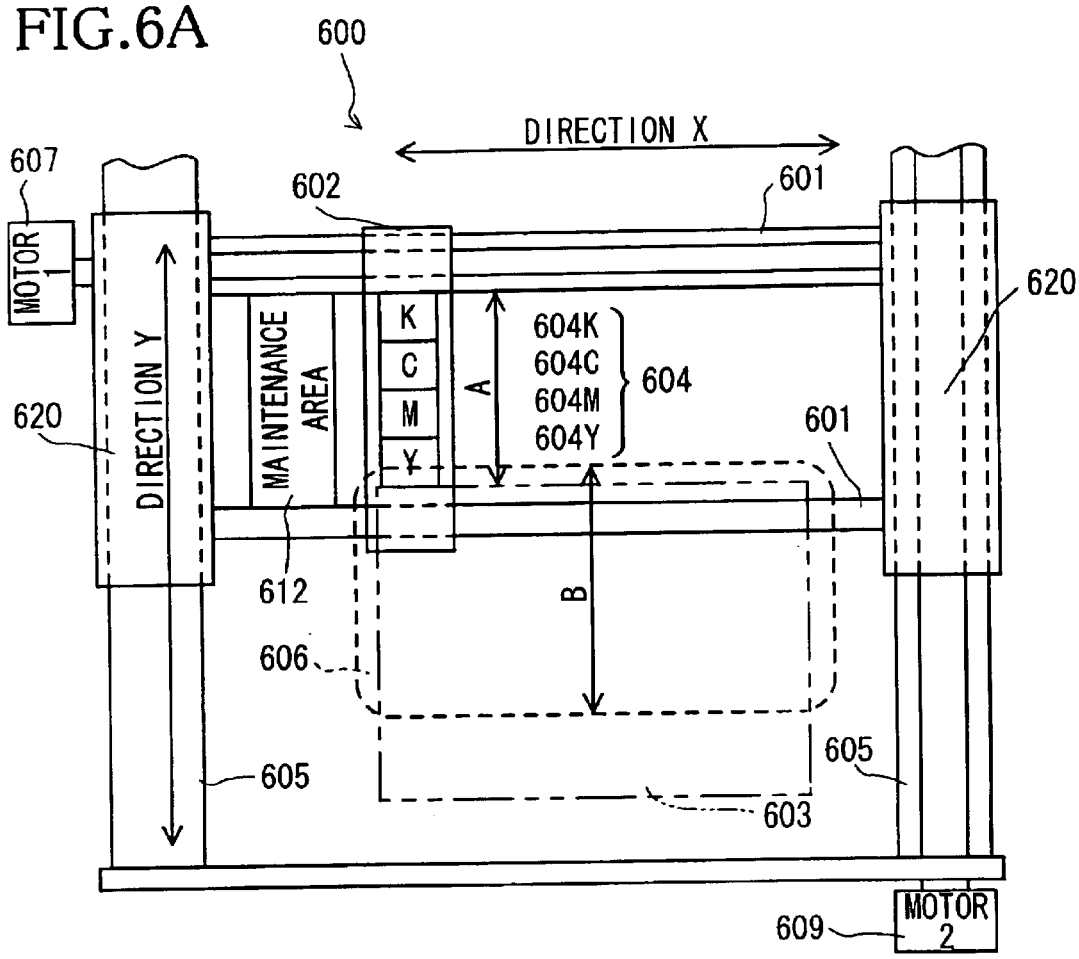
FIG. 6A is a plan view of a color ink jet printer of a third embodiment of the invention.
Figure 6B:
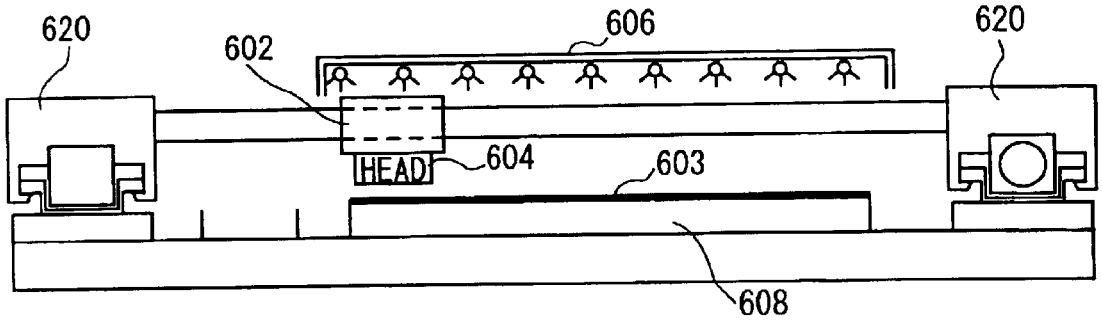
FIG. 6B is a front view of the color ink jet printer of the third embodiment.

A third embodiment of the invention will be described with reference to FIGS. 6A to 8. As shown in FIGS. 6A and 6B, a color ink jet printer 600 of the third embodiment includes a carriage 602, a print head 604, Y-axis guide bars 605, 605, a UV lamp 606, an X-axis motor 607, a platen 608, a Y-axis motor 609 and a maintenance area 612. The carriage 602 is guided by X-axis guide bars 601, 601 and movable in the main scanning direction (the X-axis direction). The print head 604 is provided on the carriage 602 and includes a Y head 604Y for yellow ink, an M head 604M for magenta ink, a C head 604C for cyan and a K head 604K for black ink aligned in the scanning direction of a recording medium 603 (in the sub scanning direction). The Y-axis guide bars 605, 605 guide, in the sub scanning direction (the Y-axis direction), support members 620 for supporting the X-axis guide bars 601, 601 that guide the carriage 602. The UV lamp 606 is fixedly disposed above the recording medium 603. The X-axis motor 607 moves the carnage 602 in the main scanning direction. The platen 608 holds the recording medium 603 on its top by air absorption. The Y-axis motor 609 moves an assembly of the X-axis guide bars 601, 601 and the support members 620, along the Y-axis direction. As shown in FIG. 6A, the UV lamp 606 has a width that is wider than the recording medium 603 and a length that is long enough to cover an area to be printed in the recording medium 603. The maintenance area 612 is an area in which purging, wiping, flushing and the like are performed.

Figure 7:
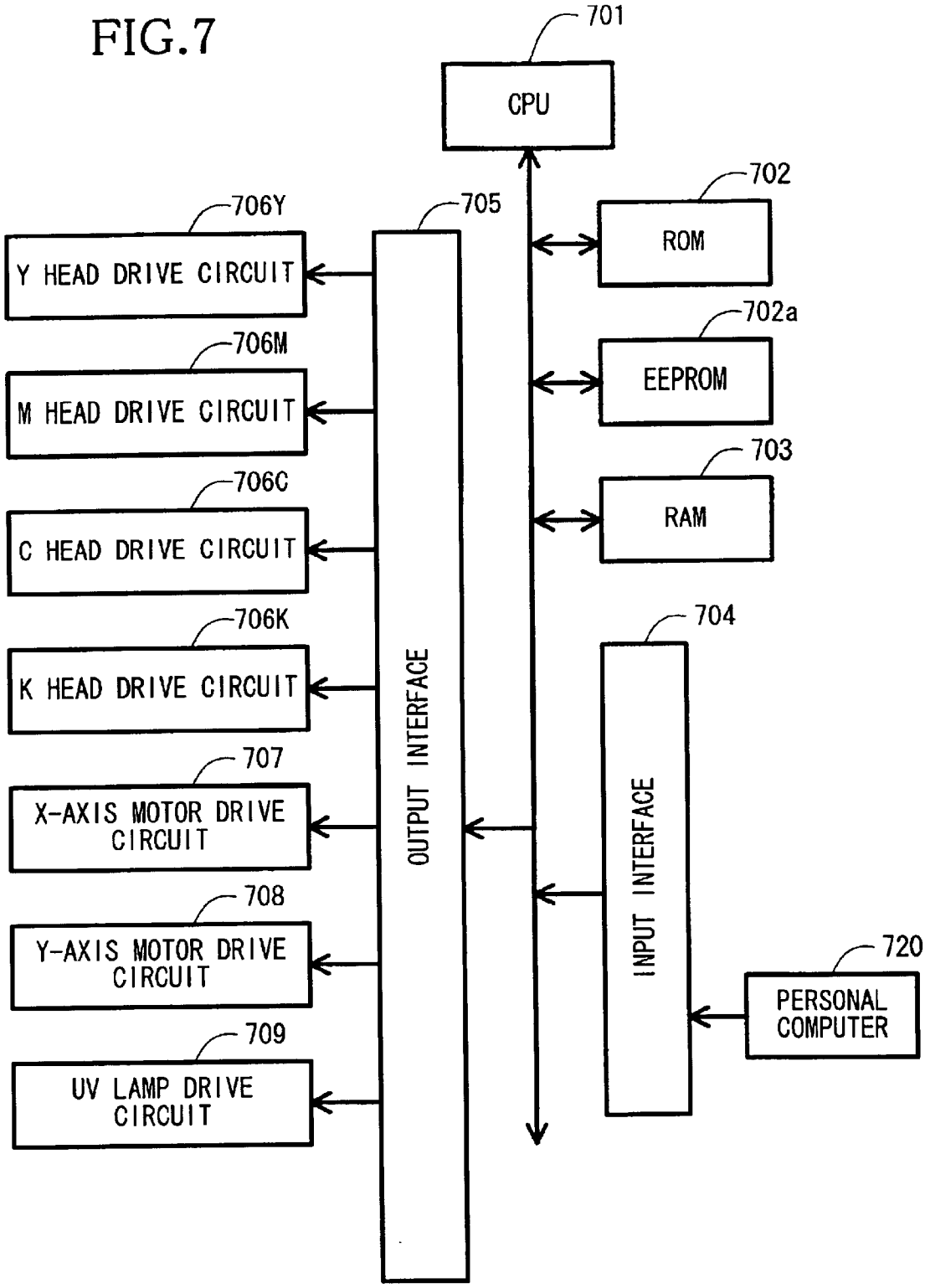
FIG. 7 is a schematic block diagram showing a control system of the ink jet printer of the third embodiment.

As shown in FIG. 7, a control system of the color ink jet printer 600 includes a CPU 701, a ROM 702, an EEPROM 702*a*, a RAM 703, an input interface 704 and an output interface 705. The output interface 705 is connected with a Y head drive circuit 706Y, an M head drive circuit 706M, a C head drive circuit 706C, a K head drive circuit 706K, an X-axis motor drive circuit 707, a Y-axis motor drive circuit 708 and a UV lamp drive circuit 709. A control signal and data from a personal computer 720 are inputted into the input interface 704.

Figure 8:
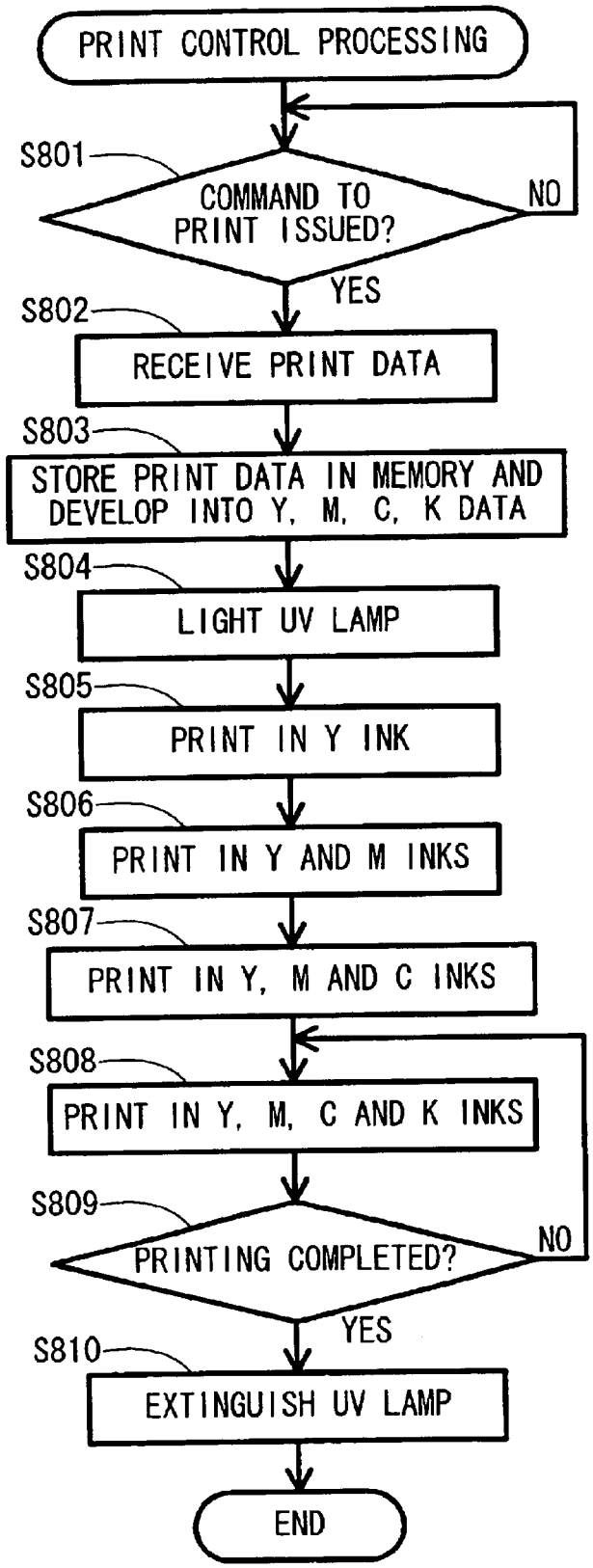
FIG. 8 is a flowchart of control processing to be executed in the ink jet printer of the third embodiment.

As shown in FIG. 8, in print control processing of the third embodiment, the CPU 701 determines whether a command to start printing has issued from the personal computer 720 (S801). When the CPU 701 determines that the command to start printing has been issued (S801:YES), the CPU 701 receives print data (S802). After the CPU 701 receives all print data, the CPU 701 stores the print data into the RAM 703 and develops the print data into Y, M, C and K data (S803). Then, the CPU 701 lights the UV lamp 606 (S804).

Then, according to the Y data, while outputting one line of dot data to the Y head drive circuit 706Y, the CPU 701 performs one-line printing in the UV cure yellow ink by moving the carriage 702 in the main scanning direction (S805). Next, the CPU 701 moves carriage 602 in the sub scanning direction by one line. Then, while outputting each one line of the dot data to the respective Y and M head drive circuits 706Y and 706M based on the Y and M data, respectively, the CPU 701 performs one-line printing in each of the UV yellow ink and the UV magenta ink by moving the carriage 602 in the main scanning direction (S806).

Then, the CPU 701 moves the carriage 602 in the sub scanning direction by one line. Next, while outputting each one line of the dot data to the respective Y, M and C head drive circuits 706Y, 706M and 706C based on the Y, M and C data, respectively, the CPU 701 performs one-line printing in each of the UV yellow ink, the UV magenta ink and the UV cyan ink by moving the carriage 602 in the main scanning direction (S807).

Next, the CPU 701 moves the carriage 602 in the sub scanning direction by one line. While each one line of the dot data to the respective Y, M, C and K head drive circuits 706Y, 706M, 706C and 706K based on the Y, M, C and K data, respectively, the CPU 701 performs one-line printing in each of the UV yellow ink, the UV magenta ink, the UV cyan ink and the UV black in by moving the carriage 602 in the main scanning direction (S808). Then, the CPU 701 determines whether the printing has completed (S809). If the CPU 701 determines that the printing has not completed (S809:NO), the processing at S808 is repeated until the printing is completed. When the CPU 701 determines that the printing has completed (S809:YES), the CPU 701 extinguishes the UV lamp 606 (S810). Thus, the processing has completed.

According to the color ink jet printer 600 of the third embodiment, the carriage 602 can be downsized because the UV lamp 606 is not mounted on the carriage 602. As compared with the first and second embodiments, in the color ink jet printer 600 of the third embodiment, the UV lamp 606 irradiates the entire printed area of the recording medium 603 and the carriage 602 can be downsized as described above. Therefore, cure of the ink is expedited and the printing speed can become fast. If the UV lamp 606 breaks down, repairs or replacements of the UV lamp 606 can be performed without removing other parts other than the UV lamp 606. Accordingly, the color ink jet printer 600 of the third embodiment has the advantage over the color ink jet printers 100 of the first and second embodiment.

According to the color ink jet printer 600 of the third embodiment, constant energy of ultraviolet light is always irradiated onto the entire printed area of the recording medium 603, so that the cure of ink can be further expedited. Accordingly, the time required for printing can be extremely shortened. Further, in the color ink jet printer 600, the UV lamp 606 is attached to the printer body instead of being mounted on the carriage 602, so that the weight of the UV lamp 606 that applies on the carriage 602 can be lightened. This results in speeding up the carriage movement and shortening the time required for printing.

Figure 9B:
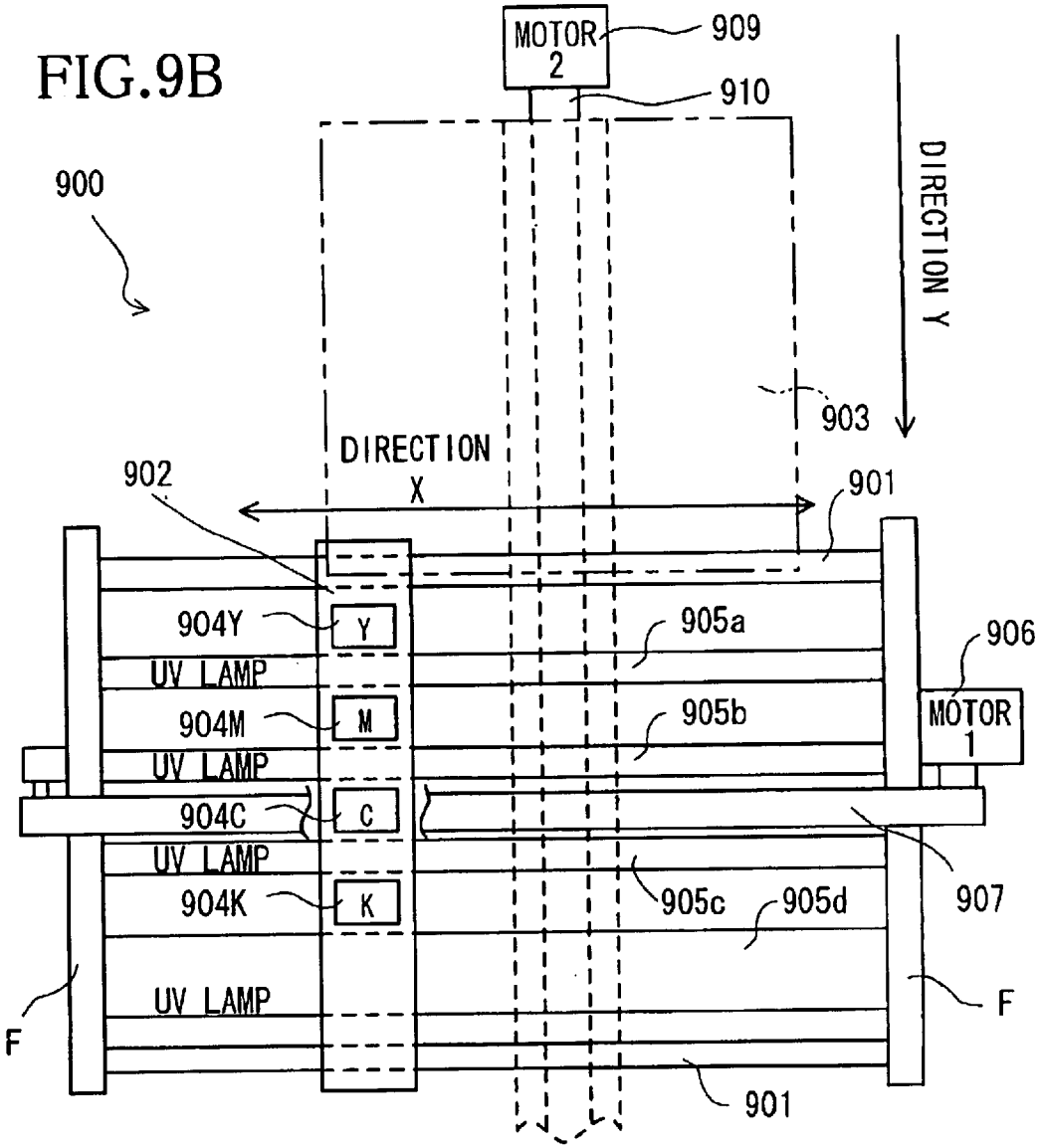
FIG. 9B is a plan view of the color ink jet printer of the fourth embodiment.
Figure 9A:
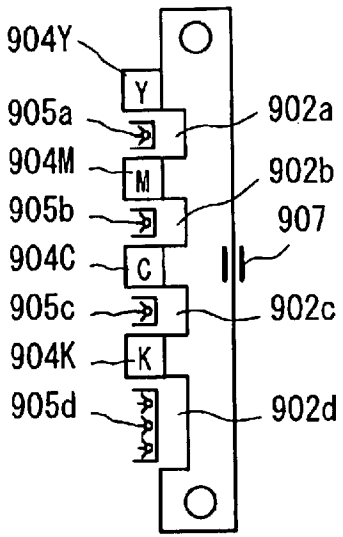
FIG. 9A is a left side view of a color ink jet printer of a fourth embodiment of the invention.
Figure 9C:
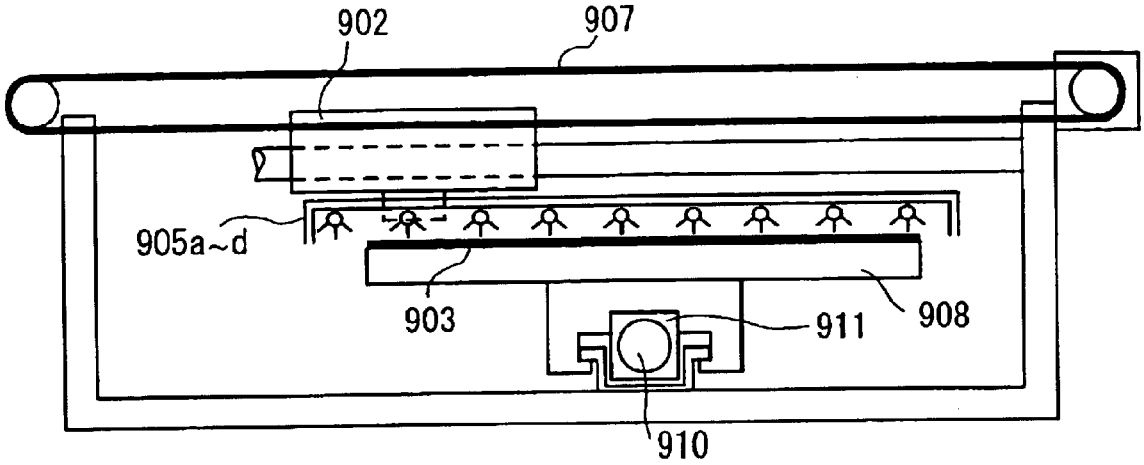
FIG. 9C is a front view of the color ink jet printer of the fourth embodiment.

A fourth embodiment will be described with reference to FIGS. 9A to 11. As shown in FIGS. 9A to 9C, a color ink jet printer 900 of the fourth embodiment includes a carriage 902 that is guided by X-axis guide bars 901, 901 supported by a frame F and movable in the main scanning direction (the X-axis direction), a Y head 904Y for yellow ink, an M head for magenta ink, a C head for cyan ink and a K head for black ink. The heads 904Y, 904M, 904C, 904K are aligned in this order in the scanning direction of a recording medium 903 (the sub scanning direction). The color ink jet printer 900 is provided with first to fourth UV lamps 905*a* to 905*d* under the carriage 902. The first UV lamp 905*a* is attached to the printer body so as to extend in the main scanning direction between the Y head 904Y and the M head 904M. The second UV lamp 905*b* is attached to the printer body so as to extend in the main scanning direction between the M head 904M and the C head 904C. The third UV lamp 905*c* is attached to the printer body so as to extend in the main scanning direction between the C head 904C and the K head 904K. The fourth UV lamp 905*d* is attached to the printer body so as to extend in the main scanning direction on a near side of the K head 904K. The color ink jet printer 900 further includes an X-axis motor 906, a timing belt 907, a platen 908, a Y-axis motor 909, a screw shaft 910 and a bearing 911. The X-axis motor 906 is attached to the one of side walls of the frame F and moves the carriage 902 in the main scanning direction. The timing belt 907 is stretched between a drive pulley fixed to an output shaft of the X-axis motor 906 and a driven pulley attached to the other side wall of the frame F and is engaged with the carriage 902. The platen 908 statically holds a recording medium 903 on its top by air absorption. The Y-axis motor 909 moves the platen 908 in the sub scanning direction (the Y-axis direction). The screw shaft 901 is rotated by the Y-axis motor 909. The bearing 911 is disposed under the platen 908 and constitutes a screw mechanism by engaging the screw shaft 910.

As shown in FIG. 9B, the first to fourth UV lamps 905*a* to 905*d* are longer in length than the width of the recording medium 903. The width of the fourth UV lamp 905*d* is wider in the sub scanning direction than that of the other UV lamps 905*a*, 905*b*, 905*c*. Each of the UV lamps 905*a*, 905*b*, 905*c* can irradiate a one line of printed portion with ultraviolet light. The UV lamp 905*d* can irradiate a three or four lines of printed portion with ultraviolet light. The first to fourth UV lamps 905*a* to 905*d* are attached to the frame F while disposed in recessed portions 902*a* to 902*d* provided the lower surface of the carriage 902, respectively. The spaces between heads 904Y, 904M, 904C, 904K are equal to the width of a one line of printed portion in the sub scanning direction.

Figure 10:
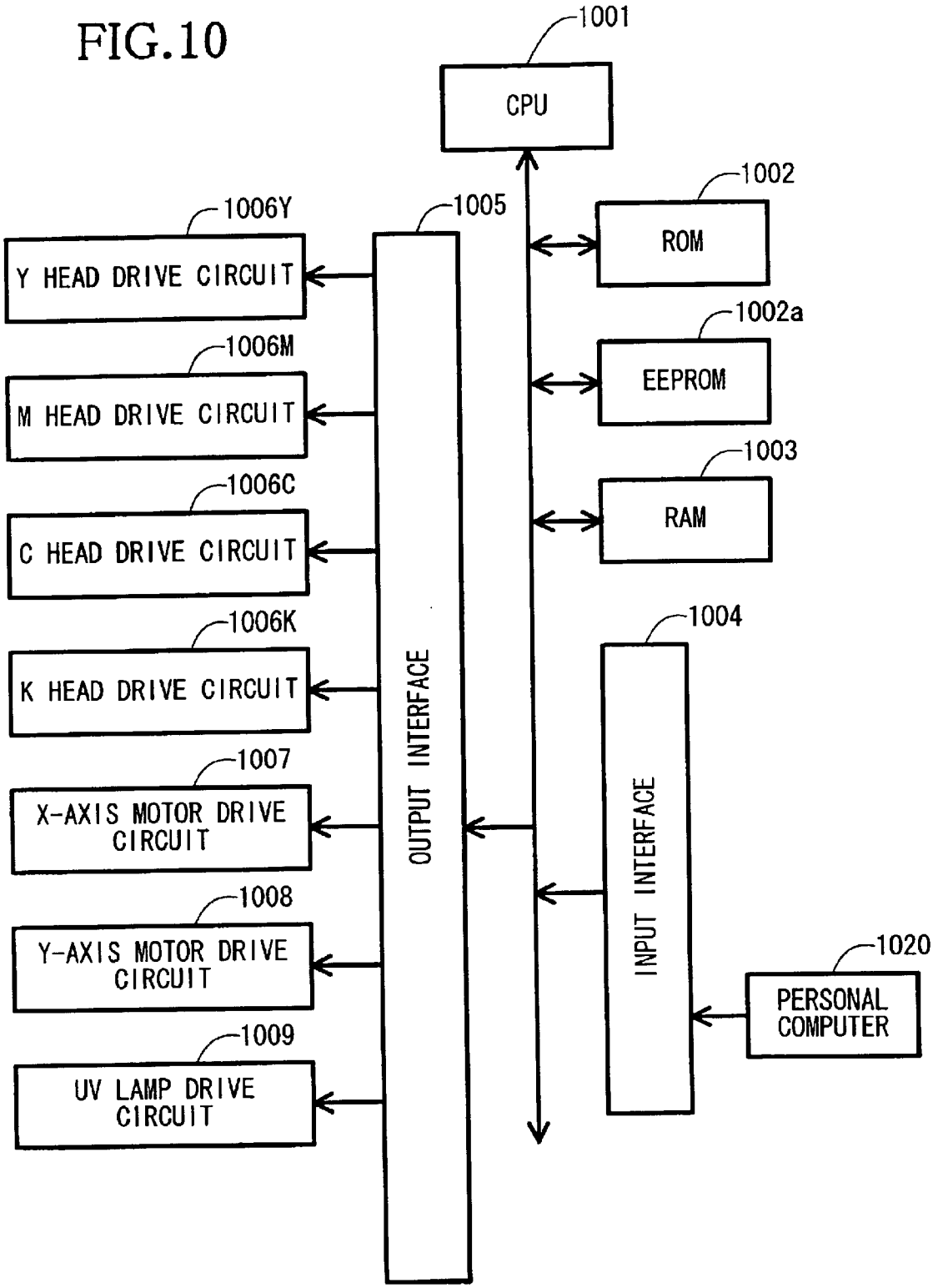
FIG. 10 is a schematic block diagram showing a control system of the ink jet printer of the fourth embodiment.

As shown in FIG. 10, a control system of the color ink jet printer 900 includes a CPU 1001, a ROM 1002, an EEPROM 1002*a*, a RAM 1003, an input interface 1004 and an output interface 1005. The output interface 1005 is connected with a Y head drive circuit 1006Y, an M head drive circuit 1006M, a C head drive circuit 1006C, a K head drive circuit 1006K, an X-axis motor drive circuit 1007, a Y-axis motor drive circuit 1008 and a UV lamp drive circuit 1009. A control signal and data from a personal computer 1020 are inputted to the input interface 1004.

Figure 11:
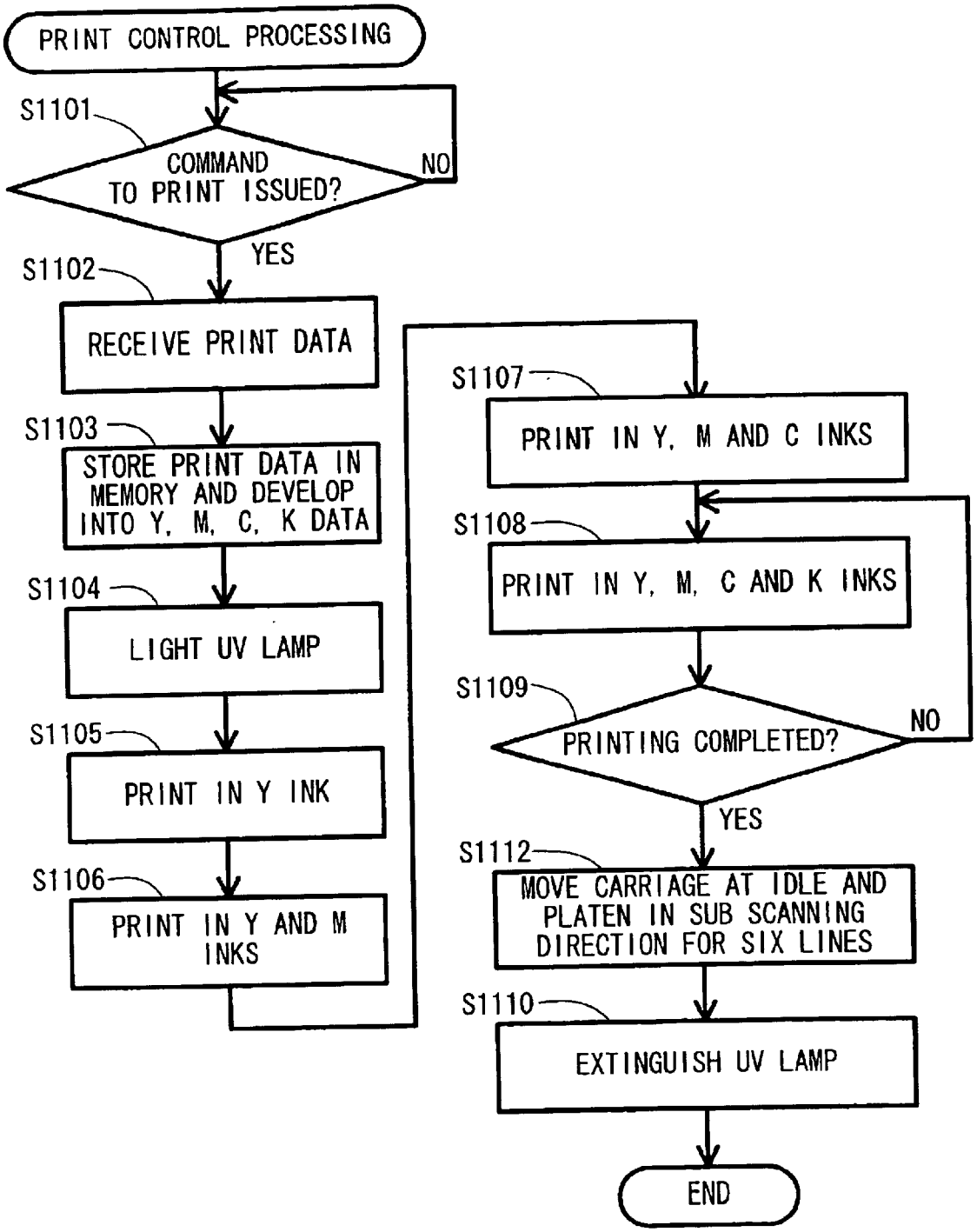
FIG. 11 is a flowchart of control processing to be executed in the ink jet printer of the fourth embodiment.

As shown in FIG. 11, in print control processing of the third embodiment, the CPU 1001 determines whether a command to start printing has been issued from the personal computer 1020 (S1101). When the CPU 1001 determines that the command to start printing has been issued (S1101:YES), the CPU 1001 receives print data (S1102). After the CPU 1101 receives all print data, the CPU 1001 stores the print data into the RAM 1003 and develops the print data into Y, M, C and K data (S1103). Then, the CPU 1001 lights the first to fourth UV lamps 905*a* to 905*d* (S1104). Then, according to the Y data, while outputting one line of dot data to the Y head drive circuit 1006Y, the CPU 1001 performs one-line printing, in two lines, in the UV yellow ink (S1105). The space between each head 904Y, 904M, 904C, 904K in the sub scanning direction is equal to the width of a one line of printed portion. Therefore, printing in the yellow ink needs to be performed in two lines in a position where the M head 904M will eject ink droplets.

Then, the CPU 1001 moves the platen 908 in the sub scanning direction by one line. Then, while outputting each one line of the dot data to the respective Y and M head drive circuits 1006Y and 1006M based on the Y and M data, respectively, the CPU 1001 performs one-line printing, in two lines, in each of the UV yellow ink and the UV magenta ink by moving the carriage 902 in the main scanning direction (S1106).

Then, the CPU 1001 moves the platen 908 in the sub scanning direction by one line. Next, while outputting each one line of the dot data to the respective Y, M and C head drive circuits 1006Y, 1006M 1006C based on the Y, M and C data, respectively, the CPU 1001 performs one-line printing, in two lines, in each of the UV yellow ink, the UV magenta ink and the UV cyan ink by moving the carriage 902 in the main scanning direction (S1107).

Next, the CPU 1001 moves the platen 908 in the sub scanning direction by one line. Then, while outputting each one line of the dot data is the respective Y, M, C and K head drive circuits 1006Y, 1006M, 1006C and 1006K based on the Y, M, C and K data, respectively, the CPU 1001 performs one-line printing, in one line, in each of the UV yellow ink, the UV magenta ink, the UV cyan ink and the UV black ink by moving the carriage 902 in the main scanning direction (S1108).

Then, the CPU 1001 determines whether the printing has completed (S1109). If the CPU 1001 determines that the printing has not completed yet (S1109:NO), the processing at S1108 is repeated until the printing is completed. When the CPU 1001 determines that the printing has completed (S1109:YES), the CPU 1101 performs operations, six times, such that the CPU 1001 moves the carriage 902 by one line and then moves platen 908 in the sub scanning direction by a predetermined amount (S1112). After that, the CPU 1001 extinguishes the first to fourth UV lamp 905*a* to 905*d* (S1110). Thus, the processing has completed. The S1112 is provided to average the time of the irradiation of the ultraviolet light with respect to all color of inks, as is the case with the first embodiment.

According to the color ink jet printer 900 of the fourth embodiment, the printing operation is performed as described below.

First, one-line printing is performed using the Y head 904Y. Then, the recording medium 903 is moved by one line, and one-line printing is again preformed using the Y head 904Y.

Next, the recording medium 903 is moved by one line, and then each one-line printing is performed using the respective Y and M heads 904Y and 904M. After that, the recording medium 903 is moved by one line, and then each one-line printing is again performed using the respective Y and M heads 904Y and 904M.

Next, the recording medium 903 is moved using one line, and then each one-line printing is performed by the respective Y, M and C heads 904Y, 904M and 904C. Then, the recording medium 903 is moved by one line, and then each one-line printing is again performed using the respective Y, M and C heads 904Y, 904M and 904C.

After that, the recording medium 903 is moved by one line, and then each one-line printing is performed using the respective Y, M, C and K heads 904Y, 904M, 904C and 904K. Next, the recording medium 903 is moved by one line, and then each one-line printing is again performed using the respective Y, M, C and K heads 904Y, 904M, 904C and 904K.

After that, each one-line printing using the respective Y, M, C and K heads 904Y, 904M, 904C and 904K is repeated. Then, each one-line printing is performed using the respective M, C and K heads 904M, 904C and 904K. Then, each one-line printing is performed using the C and K heads 904C and 904K. At last, the last line is printed by the only K head 904K. As described above, the printing is performed and the recording medium is moved.

In the color ink jet printer 900, the time required for printing can be shortened. The UV lamps 905*a* to 905*d* are not mounted on the carriage 902, but attached to the printer body. Therefore, the weight of the UV lamps 905*a* to 905*d* that applies on the carriage 902 can be lightened. This results in speeding up the carriage movement and shortening the time required for printing.

In the color ink jet printer 900, before each one-line printing is performed, the CPU 1001 performs analysis on the print data for each head 904Y, 904M, 904C, 904K. As a result of this, when there is an ink jet head that has no data for one-line printing, the CPU 1001 stays off at least a UV lamp, which is disposed immediately downstream of the ink jet head in the sub scanning direction, until printing is performed on a next line. For example, when there is no data for one-line printing as to the Y head 904Y in a path, the CPU 1001 stays the UV lamp 905*a* off until printing of a next path is performed. In the extreme cases, for example, when the ink jet printer 900 performs printing in monochrome, for example, in black ink, the CPU 1001 lights the only UV lamp 905*d* and stays the rest of the UV lamps 905*a* to 905*c* off. By doing so, energy consumption of the UV lamps 905*a* to 905*d* can be effectively reduced.

According to the color ink jet printer 900, the V lamps 905*a* to 905*d* are disposed below the carriage 902 (the surface facing the recording medium of the carriage 902), so that the carriage 902 does not offer shades on the recording medium. Therefore, ink can be excellently cured. Further, the UV lamps 905*a* to 905*d* are attached to the frame F so that the UV lamps 905*a* to 905*d* are put in the respective recessed portions 902*a* to 902*d* provided in the lower surface of the carriage 902. Accordingly, though the UV lamps 905*a* to 905*d* are attached under the carriage 902, a distance between the ink jet heads 904Y, 904M, 904C, 904K and the recording medium 903 does not need to be longer and the printing performance does not be decreased.

Although the invention has been described in detail with reference to specific embodiments thereof, it would be apparent to those skilled in the art that various changes and modifications may be made therein without departing from the spirit of the invention.

For example, ink jet heads containing light yellow (LY) ink, light magenta (LM) ink, light cyan (LC) ink can be used in addition to the ink jet heads containing yellow ink, magenta ink, cyan ink and black ink. In this case, if all the ink jet heads are aligned in the sub scanning direction on a carriage, a print head becomes extremely long and the carriage becomes large in size. This results in upsizing the ink jet printer. To avoid this, the ink jet heads to be mounted on the carriage are divided into two groups, for example, Y, M, C and K heads in one group and LY, LM and LC heads in another group, and aligned in two rows. When the ink jet heads are aligned in two rows as described above, it is preferred that a UV lamp, extending in the sub scanning direction as described in the first and second embodiments, is disposed between the two rows.

The ink jet head is not limited to an ink jet head having colored ink for color printing. For example, however, the ink jet head may contain transparent colorless ink. The ink jet head having the transparent colorless ink can be disposed so as to eject ink droplets prior to ink ejection by other ink jet heads to implement surface treatment on a recording medium before an image is formed on the recording medium. The ink jet head having transparent colorless ink can be controlled so as to eject ink droplets onto the recording medium at the last to perform surface treatment onto an image formed on the recording medium.

Ink to be used in printing is not limited to the ultraviolet cure ink used in the aforementioned embodiments. However, the ink can be thermosetting ink. When the thermosetting ink is used, a heating device, such as a heater, is provided, instead of the UV lamp.

In the fourth embodiment, the on and off of each UV lamp is controlled according to the presence or absence of data for each ink jet head by path in print data. However, not only on and off control, but also the irradiation amount of ultraviolet light by the UV lamp may be controlled so as to be gradually changed according to a ink remaining amount in contemplation of the amount of ink to be ejected from the ink jet head based on the print data. This can be applied to not only the color ink jet printer of the fourth embodiment, but also the color ink jet printers of the first to third embodiments.

While the invention has been described in conjunction with a specific embodiments outlined above, it is evident that many alternatives, modifications and variations will be apparent to those skilled in the art. Accordingly, the preferred embodiment of the invention, as set forth above, is intended to be illustrative, not limiting. Various changes may be made without departing from the spirit and scope of the invention.

What is claimed is:

1. An ink jet recording apparatus, comprising:

at least three ink jet heads, each of which ejects ink droplets of a different kind of ink that can be cured by irradiation of energy toward a recording medium;

a carriage that is movable, with respect to the recording medium, in a main scanning direction and in a sub scanning direction perpendicular to the main scanning direction, with the ink jet heads mounted on the carriage and aligned in the sub scanning direction;

a movement generating device that moves the carriage with respect to the recording medium;

a print control device that controls the ink jet heads and movement generating device so that the ink droplets ejected from each of the ink jet heads overlap each other on the recording medium, by performing ejection of ink using the ink jet heads while moving the carriage with respect to the recording medium in the main scanning direction, and by moving the recording medium in the sub scanning direction by a predetermined amount with respect to the carriage after every ejection of ink done during one way or two way moving of the carriage in the main scanning direction is performed; and an energy generating device that irradiates the recording medium with energy for curing the ink droplets ejected on the recording medium by the ink jet heads so that each printed portion of the recording medium formed by each of the ink jet heads during one reciprocation of the carriage in the main scanning direction is irradiated, at least once, before another of the ink jet heads ejects the ink droplet to a portion of the recording medium which is the same portion as the printed portion formed by the one of the ink jet heads, wherein the energy generating device has a plurality of individual energy irradiating portions attached so as to always locate at least between each ink jet head.

2. The ink jet recording apparatus according to claim 1, further comprising a holding member that statically holds the recording medium, and wherein the movement generating device is designed to move the carriage in both the main and sub scanning directions.

3. The ink jet recording apparatus according to claim 1, further comprising a holding member that holds the recording medium and where the recording medium is moved with respect to the carriage by the relative movement generating device, and wherein the energy generating device has energy irradiating areas whose lengths in the main scanning direction are longer than or equal to a length of a printed area of the recording medium in the main scanning direction.

4. The ink jet recording apparatus according to claim 3, wherein the energy irradiating areas have widths in the sub scanning direction that are longer than or equal to a width of a printed area that can be formed by each ink jet head in sub scanning direction.

5. The ink jet recording apparatus according to claim 3, wherein the energy generating device is attached to the ink jet recording apparatus separately from the carriage, the holding member is movable in the sub scanning direction together with the recording medium, and the carnage can only move in the main scanning direction.

6. The ink jet recording apparatus according to claim 5, wherein the carriage has recessed portions on a side facing the recording medium of the carriage according to the energy irradiating portions so that each of the energy irradiating portions does not interfere with the carriage.

7. The ink jet recording apparatus according to claim 3, wherein the energy generating device has the plurality of energy irradiating portions that are disposed downstream in the sub scanning direction of each ink jet head, and further comprising:

an analyzing device that analyzes a status of print data for each ejection of ink during one way or both ways moving of the carriage in the main scanning direction by each ink jet head; and a drive control device that controls on and off of the energy irradiating portions individually according to analytical results of the analyzing device.

8. The ink jet recording apparatus according to claim 7, wherein when the analyzing device determines that the printing operation is performed in monochrome, the drive control device controls such that only one of the energy irradiating portions that is located downstream in the main scanning direction of the one ink jet head that is being driven is driven.

9. The ink jet recording apparatus according to claim 1, wherein the number of ink jet heads are equal to the number of colors of inks that are colored for color printing.

10. The ink jet recording apparatus according to claim 1, further comprising:

an analyzing device that analyzes a status of print data for each ejection of ink during one way or both ways moving of the carriage in the main scanning direction by each ink jet head; and a drive control device that controls the drive of the energy generating device according to analytical results of the analyzing device.

11. The ink jet recording apparatus according to claim 1, wherein the at least three ink jet heads are aligned in line in the sub scanning direction and integral to form a monolithic structure.

12. The ink jet recording apparatus according to claim 1, wherein the energy generating device is kept driven while the carriage is driven at idle for several lines even after all ejections of ink on the recording medium has completed.

13. The ink jet recording apparatus according to claim 1, wherein the ink can be cured by irradiation of ultraviolet rays, and the energy generating device is constituted at least one ultraviolet lamp.

14. The ink jet recording apparatus according to claim 1, wherein the ink can be cured by irradiation of heat, and the energy generating device is constituted by at least one heater.

15. A method of printing with at least three ink jet heads mounted on a carriage, each of which ejects ink droplets of a different kind of ink that can be cured by irradiation of energy toward a recording medium, wherein a plurality of individual energy irradiating portions are attached so as to always locate at least between each ink jet head, comprising:

ejecting ink from a first ink jet head while moving the carriage in a first direction with respect to the recording medium, from a second ink jet head so that ink droplets ejected from the second ink jet head overlaps cured ink droplets previously ejected on the recording medium by the first ink jet head and from a third ink jet head so that ink droplets ejected from the third ink jet head overlap cured ink droplets previously ejected on the recording medium by the first ink jet head and the second ink jet head, wherein each of the first ink jet head, the second ink jet head and the third ink jet head ejects ink droplets during one reciprocation of the carriage in the first direction; and irradiating the recording medium with energy for curing ink droplets ejected on the recording medium by the ink jet heads so that a printed portion of the recording medium formed by the ink jet heads during one reciprocation of the carriage in the first direction is irradiated.

16. The method of claim 15, wherein printing with a fourth ink jet head comprising:

ejecting ink from the first ink jet head while moving the carriage in the first direction with respect to the recording medium, from the second ink jet head so that ink droplets ejected from the second ink jet head overlaps cured ink droplets previously ejected on the recording medium by the first ink jet head, from the third ink jet head so that ink droplets ejected from the third ink jet head overlaps cured ink droplets previously ejected on the recording medium by the first ink jet head and the second ink jet head and from the fourth ink jet head so that ink droplets ejected from the fourth ink jet head overlaps cured ink droplets previously ejected on the recording medium by the first ink jet head, the second ink jet head and the third ink jet head; and irradiating the recording medium with energy for curing ink droplets ejected on the recording medium by the ink jet heads so that a printed portion of the recording medium formed by the ink jet heads during one reciprocation of the carriage in the first direction is irradiated.

* * * * *